US005328027A

United States Patent [19]

Hollar et al.

[11] Patent Number: 5,328,027

[45] Date of Patent: Jul. 12, 1994

[54] CORRUGATED PAPERBOARD CONTAINER

[75] Inventors: Gene Hollar, Houston; John Schafer, Laredo, both of Tex.

[73] Assignee: Titon Industries, Inc., Atlanta, Ga.

[21] Appl. No.: 99,934

[22] Filed: Jul. 29, 1993

[51] Int. Cl.[5] ..... B65D 81/02

[52] U.S. Cl. ..... 206/320; 206/521; 229/149; 229/183

[58] Field of Search ..... 206/320, 521; 229/142, 229/143, 147, 148, 149, 151, 154, 183

[56] References Cited

U.S. PATENT DOCUMENTS

| | | | |
|---|---|---|---|
| 2,509,447 | 5/1950 | Prawdzik | 206/320 |
| 3,289,825 | 12/1966 | Smith | 206/320 |
| 3,933,300 | 1/1976 | Dempster | 229/183 |
| 4,239,148 | 12/1980 | Sorenson et al. | 229/149 |
| 4,511,079 | 4/1985 | Lopez | 229/183 |

FOREIGN PATENT DOCUMENTS

| | | | |
|---|---|---|---|
| 2229416 | 9/1990 | United Kingdom | 206/320 |

OTHER PUBLICATIONS

Photo 1.
Photo 2.
Photo 3.

*Primary Examiner*—Jimmy G. Foster
*Attorney, Agent, or Firm*—Kennedy & Kennedy

[57] ABSTRACT

A corrugated paperboard blank that folds together to form a container for enclosing a tank or other fragile article. A pair of seats space the article from a bottom and an upper support extends inwardly to hold the article from movement during shipping and handling. A support panel foldably attaches to an offset flange at an upper edge of the container. The flange spaces the support panel below the upper edge of the container for holding items, such as a lid, separate from the article in the container. The container closes without staples or adhesive for opening, inspection of the articles and reclosing.

10 Claims, 2 Drawing Sheets

CORRUGATED PAPERBOARD CONTAINER

TECHNICAL FIELD

The present invention relates to a container for fragile goods. More particularly, the present invention relates to a corrugated paperboard container that recloses after opening for inspection of the goods with internal supports to cushion the fragile goods in the container from handling, storage, and shipping damage.

BACKGROUND OF THE INVENTION

Bathroom fixtures such as sinks and commodes are typically manufactured of a ceramic material known as vitreous china. This clay-like material is heavy yet easily molded in a liquidified form for making such fixtures. After molding the material is sprayed with a glaze and baked in a kiln. The glaze cures to a smooth hard finish. The ceramic material, however, is also fragile, and does not readily withstand shocks or sharp hits. Chips, cracks, and other damage to fixtures may occur during storage, shipping, and handling.

Commodes typically found in bathroom facilities have two sections. These sections are a bowl and a tank. After installation, the bowl supports the tank on a back portion. The tank connects to the bowl for communication of water through a flange tube to the bowl. The tank typically is a substantially rectangular cube in appearance, having a length and height greater than the width. The tank has a partially closed bottom that typically defines two openings. One opening provides a fresh water inlet into the tank. A valve mounts in the hole and a pipe extends outwardly through the hole for mating engagement with a supply pipe connected to a supply of water. The bottom further defines the second opening that includes a flange tube extending outwardly from the bottom. The flange tube inserts into the tank and to communicate water to the bowl. The top of the tank typically is open. A removable lid closes the open top after installation. The bowl and the tank typically are packaged and shipped in separate containers.

The fragile nature of the bowl and tank as discussed above impose unique requirements for a container for these goods. The container must enclose the bowl and tank for handling, storing and shipping. The container protects the goods from ships, scrapes, and other damage. Further, the container provides a support structure for handling of the bowl and tank. Often these containers are stacked one on another in order to conserve warehouse space and facilitate handling of the goods. Stacking reduces the labor and the storage costs associated with handling and storing these goods. Many of these products are manufactured in a foreign country and shipped long distances with repeated handling.

Corrugated paperboard containers have been used for storing and shipping such bowls and tanks. Generally, two different types of containers have been used to hold bowls and tanks. The container for the bowl typically folds from a single sheet of corrugated paperboard. The sheet includes scores that define a pair of side walls, a bottom and a top. The edges join together to form a container body. For example, in many of the known containers a flange folds upwardly from the bottom against a lower edge of one of the side walls. Staples connect the flange to the side wall. Each side wall also typically includes a pair of end walls foldably attached to the sides of the side wall. The bottom has an end flap that folds upwardly. The top has an end flap that folds downwardly. The end flaps on the bottom and top fold to partially close the ends of the container. The end walls then fold inwardly perpendicular to the respective side wall to close the ends. Staples or adhesive secure the end walls to the end flaps. The inner surface of one end wall typically overlaps the outer surface of another of the end walls. In another embodiment, the top comprises a pair of panels that each foldably attach to a respective side wall. In this embodiment, the bottom flap and the top flap foldably attach to a first of the end walls on each end. The first end wall folds inwardly with the bottom flap contacting the bottom of the container. The second of the end walls folds inwardly of the first and has a bottom edge that contacts the bottom flap. The first end wall then overlaps the second end wall. Adhesive secures the top flap on the end walls to the top panels to hold the container closed.

One container for holding a tank is known in the industry as a regular slotted container. The container is manufactured from a single blank of corrugated paperboard having scores to define four wall panels. A manufacturer's joint joins the longitudinal ends together in order to form a tubular container. A manufacturer's joint is well known in the industry, and comprises a flap on one side that joins the longitudinal ends together. A plurality of flaps attach along a bottom edge and a top edge of the wall panels. These flaps fold to close a bottom and a top of the container. The flaps and the manufacturer's joint typically are sealed with adhesive, staples, tape, or a combination.

The tank is placed inside the container by the manufacturer. To protect the tank from shocks and handling damage, a liner is first positioned on the bottom formed by the folded flaps. The liner typically is a sheet of foam or of corrugated paperboard. The tank sits on the liner sheet to cushion the tank and thereby avoid damage that can occur from shocks and rough handling. The lid is also placed in the container for shipping with the tank. A spacer inserts between the lid and the tank. The spacer typically comprises a separate foam or corrugated paperboard sheet or a plurality of corner tabs, which cushion contact between the lid and the tank. The container typically includes flaps that are then folded over to close the container. Staples, adhesive and tape are used to secure the flaps to the container.

While meeting the need for a container to hold ceramic tanks for commodes, the corrugated paperboard container discussed above has drawbacks which limit its usefulness. To pack the tanks in these corrugated paperboard containers requires maintaining an inventory of a number of component parts. These parts include the various liner sheets to cushion the tank and the lid. On an assembly line, the parts must be picked and inserted during packing which increases the time to package such goods.

Closing the container requires the use of staples, adhesive, tape, or a combination. The container, however, sometimes does not stay together, despite these mechanisms to hold the container together. In some instances, the container collapses or opens through rough handling. In other cases, the container is opened at a retail center by a consumer seeking to inspect the goods in the container. If the consumer does not purchase the product, it is then more difficult to sell the goods in the opened container. Consumers typically dislike purchasing an opened item. The open container suggests parts are missing or the goods are possibly damaged. An open container may also result in damage to the tank or cause injury to persons. For example, the tank may fall out of the container or other articles may contact the tank during shipping or handling, and thereby cause damage. The tank may fall and hit a person or break on the floor.

Accordingly, there is a need in the art for an improved container for packaging, storing and shipping vitreous china tanks for commodes.

SUMMARY OF THE PRESENT INVENTION

The present invention meets the needs in the art for an improved container for packaging, storing, and shipping tanks for commodes. Generally described, the container of the present invention assembles from a single blank of corrugated paperboard. The container includes a pair of seats to space the tank from a bottom panel. The container closes without the use of staples, adhesives, or tape thereby allowing opening and inspection of the tanks at retail centers. A support panel foldably joins at an upper edge of a side wall of the container. The support panel separates the lid from the tank. A side support flap grips an upper portion of the tank to restrict movement of the tank in the container.

More particularly described, the present invention provides a corrugated paperboard container with a pair of seats that each extend inwardly from a respective side panel and sit against a bottom panel of the corrugated paperboard container. The seats each include perforated scores for defining two panels that fold together to provide a cushion for supporting the tank to be held in the container.

In another aspect of the present invention, the corrugated paperboard container includes a cover foldably attached to an upper edge of one of the side walls. A pair of elongated flaps foldably attach to a respective side edge of the cover. The distal end of each flap defines a tab with outwardly extending ears. The tab in the ears insert into a hand grip opening in a respective one of the end walls to lock the cover in its closed position.

In another aspect of the present invention, a support panel for holding a lid of the tank foldably attaches to an offset flange foldably attached to an upper edge of one of the side walls. The offset flange disposes the support panel inwardly of the upper edge of the side wall. This spaces the support from the upper edge, whereby the lid for the tank sits on top of the support. The support thereby holds the lid and cushions the lid from contacting the tank in the container.

In another aspect of the present invention, an upper support panel foldably attaches to an upper edge of an inner end wall of the container. The panel folds inwardly on a score to extend a pair of arms around the tank in the container. A pair of flaps attached to the arms fold downwardly against the side of the tank. The arms and the flaps cooperate to reduce movement of the tank during shipping and handling.

Accordingly, it is an object of the present invention to improve containers for fragile articles.

It is another object of the present invention to reduce damage to goods held in a container.

It is another object of the present invention to increase the salability of goods with a reclosable container.

It is another object of the present invention to facilitate consumer inspection of goods without damaging the container.

It is another object of the present invention to reduce labor and materials costs to assemble packaging for goods.

It is another object of the present invention to increase the protection provided articles held in a corrugated paperboard container.

It is another object of the present invention to reduce the number of component pieces to be maintained in inventory for packaging goods.

These and other objects, advantages, and features of the present invention will become apparent from a reading of the following detailed description of the invention and claims in view of the appended drawings.

DETAILED DESCRIPTION OF THE PREFERRED EMBODIMENTS

Figure 1:
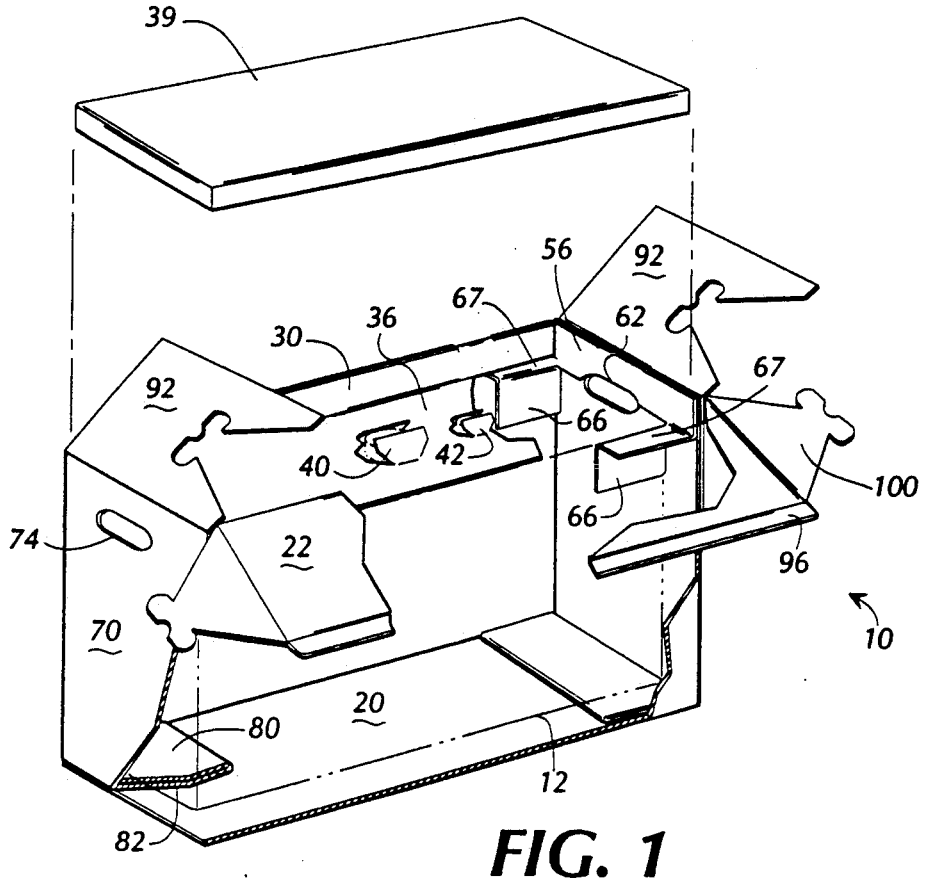
FIGS. 1 and 2 are perspective cut-away views of a preferred embodiment of the present invention of a corrugated paperboard container.
Figure 3:
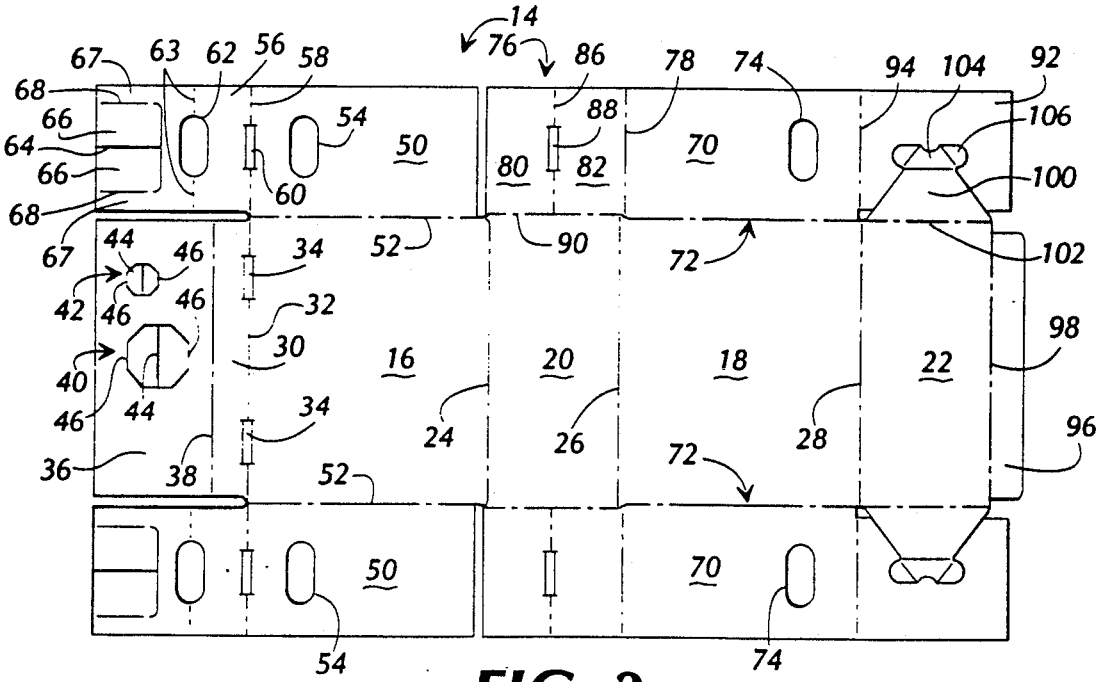
FIG. 3 is a plan view of a blank of corrugated paperboard for forming the container illustrated in FIGS. 1 and 2.
Figure 2:
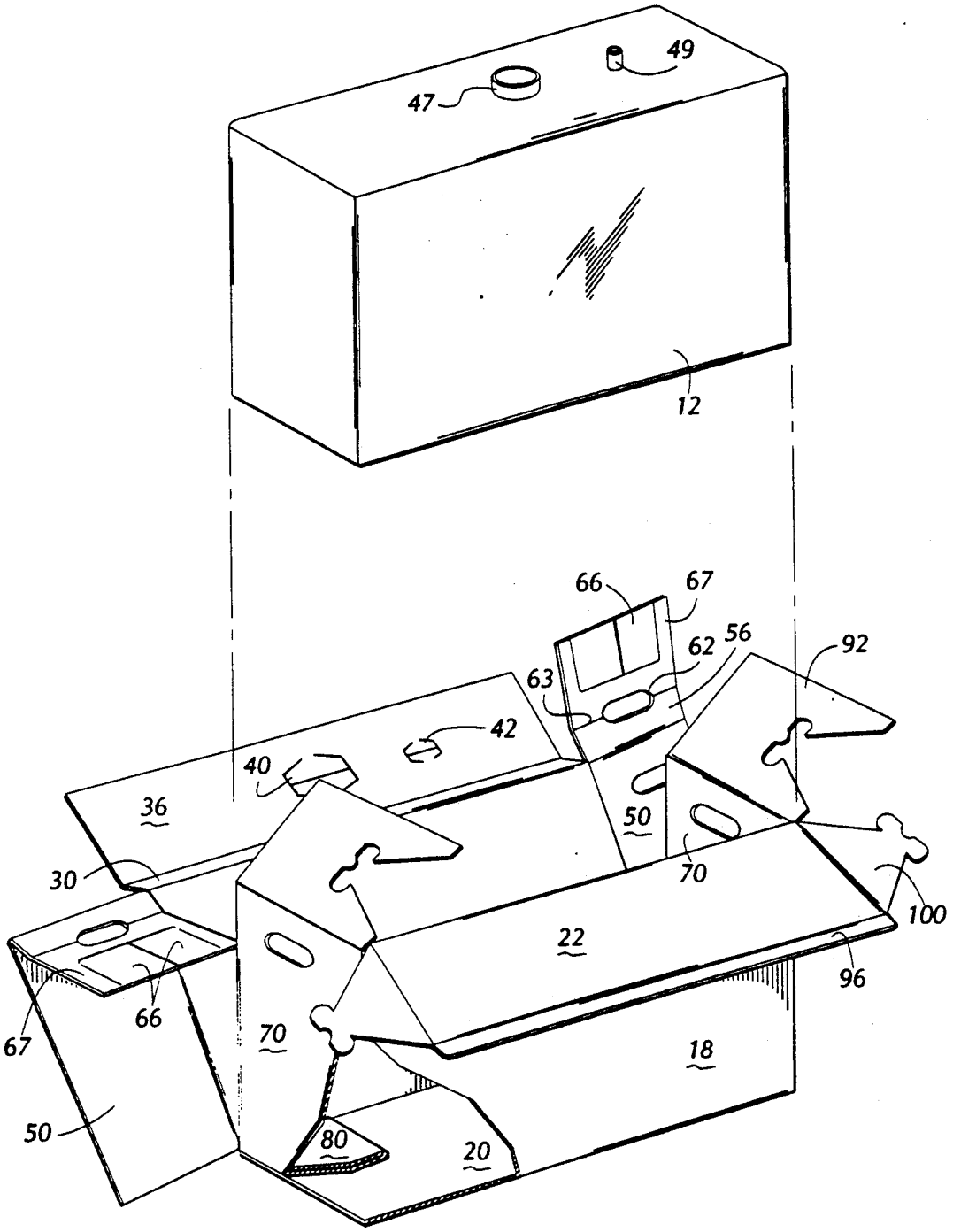

Referring now in more detail to the drawings, in which like numerals indicate like parts through the several views, FIGS. 1 and 2 illustrate perspective cutaway views of a preferred embodiment of a corrugated paperboard container 10 for holding an article, such as a tank 12 for a water closet illustrated in phantom line on the interior of the container in FIG. 1 and exploded from the container in FIG. 2. The container 10 forms from a blank 14 of corrugated paperboard material, as illustrated in FIG. 3. With reference to FIGS. 1–3, the blank 14 includes two opposing side panels 16 and 18 and two opposing bottom and top panels 20 and 22 foldably connected along three score lines 24, 26 and 28.

An offset flange 30 attaches along a hinge score 32 to an edge of the side panel 16. The score 32 is not continuous, but rather defines a pair of spaced apart connectors 34 between the flange 30 and the side panel 16. A support panel 36 attaches to the flange 30 along a score 38. The support panel holds a lid 39 for the tank 12. The support panel 36 defines two spaced apart openings 40 and 42. An slot 44 (having a general I-shape) defines each of the openings 40 and 42. The slot 44 forms two flaps 46 in each opening, and each flap foldably joins to the support panel 36 along a perforated score 48. The opening 40 receives a flange tube 47 (illustrated in FIG. 2) connected to the blank 12. A water inlet pipe 49 (illustrated in FIG. 2) connected to the tank 12 extends through the opening 42.

An inside end panel 50 foldably attaches along a respective score 52 to each of the side edges of the side panel 16. Each inside end panel 50 defines an opening 54 for a hand grip, as discussed below. An inside support panel 56 foldably attaches along a score 58 to an end edge of the panel 50. In the illustrated embodiment, the score 58 is discontinuous and defines a connector 60 bridging between the end panel 50 and the inside support panel 56. The panel 56 defines an opening 62 for a hand grip, as discussed below. When the panel 56 folds over against the end panel 50, the openings 62 and 54 align. A perforated score 63 extends from the opening 62 to the sides of the panel 56. A T-shaped slot 64 defines a pair of flaps 66 in an end portion of the flap 56. A score 68 connects each of the flaps 66 to the flap 56. The slot 64 and the score 68 define a pair of arms 67 which cooperate with the flaps 66 to grip and restrict the tank 12 from movement in the container 10.

An outer end panel 70 foldably attaches along a respective score 72 to each of the side edges of the side panel 18. Each outer side panel 70 defines an opening 74 for a hand grip, as discussed below. When the container 10 is folded together as discussed below, the opening 74 aligns with the openings 62 and 54. A bottom support 76 foldably attaches along a score 78 at a bottom edge of the end panel 70. The bottom support 76 comprises two panels 80 and 82 foldably joined together by a score 86. The score 86 defines a connector 88 that bridges between the bottom panels 80 and 82. A slot 90 separates the panels 80 and 82 from the bottom panel 20. In the illustrated embodiment, a top cover panel 92 foldably joins along a score 94 to an upper edge of each of the outer end panels 70.

As discussed above, the top 22 attaches along the score 28 to an upper edge of the side panel 18. A tab 96 connects along a score 98 to an outside edge of the top 22. The top 22 includes a pair of elongated flaps 100 foldably joined along a score 102 to each side edge of the top. A distal end 104 of each of the flaps 100 defines a pair of outwardly extending ears 106. The flap 100 with the ears 106 are cut from the top cover panel 92 that foldably joins along the score 94 to the respective outside end panels 70.

The corrugated paperboard container 10 of the present invention is assembled by folding the blank 14 as discussed below. The blank 14 preferably is shipped as a sheet from the container manufacturer to the tank manufacturer for assembly and use. In sheet form, a large number of blanks 14 can readily be handled, shipped and stored. Such sheets are known in the industry as "knock-down", which is suitable for shipping a large number of corrugated paperboard containers from a manufacturer to a user.

For use, the flat blank 14 is folded to form the container 10. Each of the support panels 76 is folded upwardly along the score 78 perpendicular to the outer side panel 70. The support panel 80 is folded upwardly along the score 86 so that the upper surfaces of the panels 80 and 82 touch. The outer side panel 70 is folded upwardly along the score 72 perpendicular to the side panel 18. The side panel 18 is folded along the score 26 perpendicular to the bottom 20. The bottom supports 76 contact and rest against the side portions of the bottom 20. The cover panel 82 and the top 22 can be folded outwardly until the tank 12 is positioned in the container 10. Although not necessary, adhesive can be applied to the panel 82 to rigidly connect the bottom support 76 to the bottom 20. While this facilitates holding the container 10 in a partially assembled position, the use of the adhesive is not necessary.

The inside support panels 56 are folded along the scores 58 against the inner surface of the inner end panels 50. This aligns the openings 62 and 54. The outer portion of the panels 56 then fold upwardly on the scores 63. The inner end panels 50 fold perpendicular to the side panel 16. The side panel 16 is folded along the score 24 perpendicular to the bottom 20. The tank 12 is then positioned inside the container 10 by lowering through the open upper end between the side walls 16 and 18 as shown in exploded view in FIG. 2. The tank 12 preferably is positioned upside down with the open top of the tank resting on the supports 76 as shown in phantom in FIG. 1. The panels 80 and 82 form a seat for spacing the edge of the tank 12 from the bottom 20. The lower edge of the inner side panels 50 contact and rest on the folded panels 80 and 82 along the score 78. The openings 62 and 54 align with the opening 74 in the outer end panel 70. The flaps 66 fold downwardly on the scores 68 and the arms 67 extend along the sides of the tank 12. The arms 67 and the flaps 66 cooperate to hold an upper portion of the tank 12 and restrict the tank from movement during shipping and handling.

The support panel 36 is then folded over the upwardly disposed bottom of the tank 12. The tank 12 typically has two openings in the bottom. One opening receives the water supply pipe 49 which connects the tank 12 to a supply of water after installation. The water supply pipe 49 for the tank 12 extends upwardly through the opening 42. The flange tube 47 (generally centrally disposed in the bottom) extends outwardly from the bottom of the tank 12. The flange tube 47 extends upwardly through the flaps 44 in the opening 40.

To position the support panel 36, the offset flange 30 is folded on the score 32 and the support panel is reverse folded on the score 38. The offset flange 30 disposes the support panel 36 inwardly and below the upper edge of the container 10. The lid 39 for the tank 12 is then placed on the support panel 36. The support panel 36 separates the lid from the bottom of the tank 12 to cushion the two from hitting during handling, shipping, and storage. The flaps 44 cushion the flange tube 47 and the water supply tube 49 from contacting the inner surface of the lid 39.

The cover panels 92 are then folded inwardly along the scores 94 to partially cover the lid 39 on the support panel 36. Finally, the top 22 is folded along the score 28 to close the container 10. The flap 96 folds on the score 98 and inserts into the container 10 against the offset flange 30. The flaps 100 fold downwardly against the outside surface of the outer end panels 70. The ears 106 at the distal end 104 of the flaps 100 insert into the openings 74 in the outer end wall panels 70. The ears 106 lock the top 22 in the closed position.

The container 10 of the present invention, however, is readily opened for inspection of the tank, or other goods held in the container. The ears 106 are detached from the openings 74 and the top 22 is folded to open the container 10. The lid of the tank 12 on the support panel 36 may be inspected, or removed for inspection of the tank on the interior of the container 10. The container 10 is then readily closed as discussed above, by folding the top 22 on the score 28 and inserting the ears 106 in the openings 74.

The container 10 is illustrated in FIGS. 1 and 2 as rectangular in end view, as appropriate for enclosing the tank of a water closet. The bowl for a water closet typically is oval in shape with a narrow pedestal base. A container for enclosing a bowl accordingly preferably has a trapezoidal shape in end view with a wide base and a narrow top. The bowl is disposed in such container upside down with the pedestal in the upper portion of the container.

The specification as thus described in various embodiments, including the preferred embodiment, a corrugated paperboard container of the present invention, including the manufacture and use thereof. It is to be understood, however, that numerous changes and variations may be made in the construction of the present invention. It should therefore be understood that modifications of the present invention may be made without departing from the scope thereof as set forth in the appended claims.

I claim:

1. A corrugated paperboard container for holding tank and lid for a water closet, comprising:

a body folded together from a blank of corrugated paperboard scored to provide a first side wall, a bottom, a second side wall, and a top;

the first side wall including an offset flange foldably attached to an end edge and a support panel for holding a lid of a tank foldably attached to the offset flange, a pair of inner end walls foldably attached to each of the side edges of the first side wall, the inner end walls each defining a first opening for a handgrip;

the second side wall including a pair of outer end walls foldably attached to opposite side edges of the second side wall, the outer end walls defining a second opening that aligns with the first opening, a bottom support panel foldably attached to a first end of each outer end wall;

the top foldably attached to an edge of the second side wall and including a pair of elongated flaps foldably attached to opposite side edges of the top, a distal end of each flap defining a tab with outwardly extending ears for insertion into the first and the second openings to lock the folded blank together, whereby the body forms by folding the outer end walls and the bottom support panels inwardly with the second side wall folded upwardly from the bottom, folding the inner end walls inwardly with the first side wall folded upwardly from the bottom so that the inner end walls contact an inner surface of the outer end walls, the body closed and locked together by folding the top and inserting the ears into the openings in the end walls.

2. The corrugated paperboard container as recited in claim 1, further comprising an upper support panel foldably attached to an upper end of each end wall and including a T-shaped slot extending inwardly from an outside edge to define two arms and two flaps, whereby the upper support panel, being folded inwardly on a score, engages the upper portion of the tank between the flaps and the arms to restrict movement during shipping and handling.

3. The corrugated paperboard container as recited in claim 1, wherein the bottom support panel comprises a pair of panels folded together.

4. A corrugated paperboard container for holding articles, comprising:

a body folded together from a blank of corrugated paperboard scored to provide a first side wall, a bottom, a second side wall, and a top;

an inner end wall foldably attached to each side edge of the first side wall and defining a first opening in an upper portion of the inner end wall;

an outer end wall foldably attached to each side edge of the second side wall and defining a second opening in an upper portion of the outer end wall, an inner surface of the outer end wall contacting an outer surface of a respective one of the inner end walls when the container is folded together;

a support panel disposed in an upper portion of the body and extending from the first side wall for separating an upper portion of the body from a lower portion;

a bottom support panel extending from a lower end of each outer end wall and contacting the bottom for spacing an article from the bottom, a bottom edge of a respective one of the inner end walls sitting on the bottom support panel; and a flap foldably attached to each side edge of the top and including a pair of ears at the distal end of the flap for inserting into the aligned first and second openings for locking the body together, whereby the body, being folded together, can be opened and reclosed by removing and inserting the ears in the openings.

5. The corrugated paperboard container as recited in claim 4, wherein the support panel foldably attaches to an offset flange foldably attached to an upper edge of the first side wall, whereby the support panel is spaced apart from the upper edge.

6. The corrugated paperboard container as recited in claim 4, wherein the bottom support panel comprises a first section and a second section foldably attached along a score to the first section, the second section folding over on top of the first section for cushioning the article on the support panel.

7. The corrugated paperboard container as recited in claim 4, further comprising an upper support panel that extends inwardly from an upper edge of each inner end wall, the upper support panel including a T-shaped slot extending inwardly from an outer edge to define a pair of arms and flaps that fold along a score with the arms for receiving an upper portion of an article in the container for resisting movement during shipping and handling.

8. A corrugated paperboard container for holding articles, comprising:

a body folded together from a blank of corrugated paperboard scored to provide a first side wall, a bottom, a second side wall, and a top;

an inner end wall foldably attached to each side edge of the first side wall and defining a first opening in an upper portion of the inner end wall;

an upper support panel that extends inwardly from an upper edge of each inner end wall, the upper support panel including a T-shaped slot extending inwardly from an outer edge to define a pair of arms and flaps that fold along a score with the arms for receiving an upper portion of an article in the container for resisting movement during shipping and handling;

an outer end wall foldably attached to each side edge of the second side wall and defining a second opening in an upper portion of the outer end wall, an inner surface of the outer end wall contacting an outer surface of a respective one of the inner end walls when the container is folded together;

a bottom support panel extending from a lower end of each outer end wall and contacting the bottom for spacing an article from the bottom, a bottom edge of a respective one of the inner end walls sitting on the bottom support panel; and a flap foldably attached to each side edge of the top and including a pair of ears at the distal end of the flap for inserting into the aligned first and second openings for locking the body together, whereby the body, being folded together, can be opened and reclosed by removing and inserting the ears in the openings.

9. The corrugated paperboard container as recited in claim 8, further comprising a support panel disposed in an upper portion of the body and extending from an offset flange foldably attached to an upper edge of the first side wall for separating an upper portion of the body from a lower portion, the support panel for holding a second article in the container separated from the article on the bottom.

10. The corrugated paperboard container as recited in claim 8, wherein the bottom support panel comprises a first section and a second section foldably attached along a score to the first section, the second section folding over on top of the first section for cushioning the article on the support panel.

* * * * *